US006368140B2

(12) United States Patent
Torii

(10) Patent No.: US 6,368,140 B2
(45) Date of Patent: Apr. 9, 2002

(54) HALF-FITTING PREVENTION CONNECTOR

(75) Inventor: Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/864,176

(22) Filed: May 25, 2001

(30) Foreign Application Priority Data

May 31, 2000 (JP) ..... 12-162967

(51) Int. Cl.[7] ..... H01R 13/627
(52) U.S. Cl. ..... 439/352; 439/489
(58) Field of Search ..... 439/352, 488–489, 439/353

(56) References Cited

U.S. PATENT DOCUMENTS 3,611,255 A * 10/1971 Shroyer ..... 439/352
5,749,747 A 5/1998 Inaba et al. ..... 439/358
5,954,531 A * 9/1999 Jennings et al. ..... 439/352
5,997,334 A * 12/1999 Goto ..... 439/352
6,106,321 A * 8/2000 Yoshida et al. ..... 439/489
6,244,889 B1 * 6/2001 James ..... 439/352

FOREIGN PATENT DOCUMENTS

JP 9-180820 7/1997 ..... H01R/13/64
JP 10-144402 5/1998 ..... H01R/13/64

* cited by examiner

*Primary Examiner*—Gary Paumen
*Assistant Examiner*—Felix O. Figueroa
(74) *Attorney, Agent, or Firm*—Sughrue Mion, PLLC

(57) ABSTRACT

In a half-fitting prevention connector (1), a resilient member (20; 25; 35) attachable to a housing (14) of a female connector (3) is employed. A longitudinal direction of the resilient member (20; 25; 35) is substantially perpendicular to a connector fitting direction of the female connector (3). A central portion of the resilient member (20; 25; 35) is fixedly secured to the housing (14) by a fixing mechanism (21; 30; 40), so that opposite end portions of the resilient member (20; 25; 35) are flexible. A pair of abutment portions (9) are formed on a flexible lock arm (5) formed on a housing (4) of a male connector (2). When the female connector (3) and the male connector (2) are fitted to each other, the abutment portions (9) are abutted against the opposite end portions of the resilient member (20; 25; 35).

3 Claims, 12 Drawing Sheets

HALF-FITTING PREVENTION CONNECTOR

BACKGROUND OF THE INVENTION

1. Field of the Invention

The present invention relates to a half-fitting prevention connector which reliably prevents half-fitting by way of the resiliency of a resilient member attached to a housing of at least one of a pair of male and female connectors which are fittable to each other, and which reliably effects fitting and locking with the mating connector.

The present application is based on Japanese Patent Application No. 2000-162967, which is incorporated herein by reference.

2. Description of the Related Art

A related example of a half-fitting prevention connector now will be described with reference to FIGS. 9 to 12.

As shown in FIGS. 9 and 10, in a half-fitting prevention connector 51, an exclusive housing 55 is provided integrally on a housing 54 of a male connector 52 of a pair of male and female connectors 52 and 53 which are fittable to each other. A pair of compression coil springs 57 are respectively accommodated in a pair of spring accommodating portions 56 on both sides of the interior of this exclusive housing 55, and half-fitting between the male and female connectors 52 and 53 is prevented by the resiliency of the compression springs 57.

In addition, the male connector 52 has a lock arm 58 which has on a lower surface of its tip a retaining pawl 59 for retaining the mating female connector 53 and is supported at its rear end on the housing 54 so as to be flexible as a cantilever. Further, displacement preventing projections 60 are provided on an upper surface of the lock arm 58 on the opposite side to the side where the engaging projection is provided, and a lock peak 61 is provided on the upper surface of its root portion.

In addition, a slider 62 is slidably held in the exclusive housing 55. The slider 62 has a slider body 66 on which a slider arm 69 which is upwardly flexible by using a rear portion of the slider body 66 as a root is formed. A pair of abutment projections 70 are provided on the lower surface of a front end of the slider arm 69. Further, a pressing portion 72 which can be pressed in the rearward direction by an operator's finger is provided on the upper surface of a rear end portion of the slider body 66.

Further, provided on an upper surface of a female housing 75 are an inclined projection 77 for retaining the retaining pawl 59 and a retaining groove 79 located immediately behind it, and a pair of stopper projections 78, which abut against the abutment projections 70 of the slider 62, are provided on the upper surface of the female housing 75.

In the half-fitting prevention connector 51 having the above-described construction, the male and female connectors 52 and 53 are made to face each other and are pressed in the connector fitting directions, as shown in FIG. 10. Then, since the stopper projections 78 on the female housing 75 abut against the abutment projections 70 of the slider 62, and the slider 62 is pushed in toward the rear of the exclusive housing 55 in the upper portion of the housing 54 while compressing the compression springs 57 (see FIG. 9). Further, as the retaining pawl 59 rides over the inclined projection 77, the lock arm 58 is flexed upward, while the slider arm 69 is flexed upward by riding over the lock peak 61.

If the fitting forces of the male and female connectors 52 and 53 are canceled at this stage, the slider 62 is pushed back by the urging forces of the compression springs 57, so that the female connector 53 is pushed back by the abutment projections 70 and the stopper projections 78. Hence, the male and female connectors 52 and 53 are prevented from being left in a half-fitted state.

If the fitting operation is further advanced, as shown in FIG. 11, the slider arm 69 is flexed further upwardby the lock peak 61, and the abutment projections 70 are disengaged from the stopper projections 78, with the result that the slider 62 is pushed back forwardly by the urging forces of the compression springs 57 (see FIG. 9), and the front end of the pressing portion 72 abuts against the lock peak 61 and stops.

At this time, since the retaining pawl 59 is retained by the inclined projection 77 and the retaining groove 79, the state of flexion of the lock arm 58 returns to its original state, and the displacement preventing portion 71 of the slider 62 is fitted over the displacement preventing projections 60 of the lock arm 58.

Next, to cancel the fitting between the male and female connectors 52 and 53, as shown in FIG. 12, the operator pulls the pressing portion 72 in the rearward direction while compressing the compression springs 57 (see FIG. 9) while holding the housing 75. Consequently, the slider 62 retracts to allow the displacement preventing projections 60 to be canceled from the state of being locked by the displacement preventing portion 71, and since the abutment projections 70 ride over the stopper projections 78, the slider 69 begins to be flexed upward.

If the pressing portion 72 is further pulled, at the same time as the tip portion of the slider arm 69 rides over the lock peak 61, the retaining pawl 59 becomes unlocked from the inclined projection 77 since its rear surface is inclined, so that the fitting between the male and female connectors 52 and 53 can be canceled.

However, with the above-described half-fitting prevention connector 51, there has been a possibility that since the slider 62 is required, the number of component parts increases, and the number of assembling steps increases, leading to higher cost.

In addition, since when the pressing portion 72 is pulled backward during the releasing operation for the connectors, the pressing portion 72 must be pulled while compressing the compression springs, there has been a possibility that the operating efficiency during releasing operation of the connectors is poor.

Furthermore, since resin members such as the lock arm 58 and the slider arm 69 are flexed greatly during the fitting and releasing operations of the connectors 52 and 53, there may be a problem in the durability.

SUMMARY OF THE INVENTION

The present invention has been devised in view of the above-described undesired possibilities of the related art, and its object is to provide a half-fitting prevention connector which has a small number of component parts, offers satisfactory operating efficiency during the releasing operation, and excels in the durability with small flexion of resin members during the fitting and releasing operations.

To achieve the above object, according to a first aspect of the present invention, there is provided a half-fitting prevention connector which comprises:

- a first connector including a first housing;
- a flexible lock arm formed on the first housing, the flexible lock arm having a first retaining portion and a pair of abutment portions which are located at a lower side relative to the first retaining portion, the pair of abutment portions having tapered surfaces which are opposed to each other so that an interval between the tapered surfaces becomes gradually wider in a connector releasing direction of the first connector;

a second connector fittable to the first connector, the second connector including a second housing having a second retaining portion and a press plate;

a resilient member attachable to the second housing, a longitudinal direction of the resilient member being substantially perpendicular to a connector fitting direction of the second connector; and a fixing mechanism, with which a central portion of the resilient member is fixedly secured to the second housing, so that opposite end portions of the resilient member are flexible in the connector fitting direction and a connector releasing direction of the second connector, wherein when the first connector and the second connector are about to be fitted to each other, the flexible lock arm is flexed by the press plate of the second housing pressing downward the first retaining portion, and the first retaining portion is slid on the press plate so that the pair of abutment portions of the flexible lock arm are abutted against the opposite end portions of the resilient member, wherein when the first connector and the second connector are incompletely fitted, the first connector and the second connector are released in respective directions opposite to their connector fitting directions in accordance with a resilient force of the resilient member, and wherein when the first connector and the second connector are completely fitted to each other, the first retaining portion of the flexible lock arm is retained by the second retaining portion of the second housing.

In accordance with the first aspect of the present invention, since a slider is not required, the number of component parts can be reduced, the structure is simplified, and the number of assembling steps can be reduced, thereby making it possible to lower the cost, thereby making it possible to attain a reduction in cost.

Furthermore, since the amount of the flexion of the lock arm during the fitting and releasing operations of the male and female connectors is small, and resin members other than the lock arm are not flexed, it is possible to improve the durability of the connector.

In addition, since the resilient member is so adapted as to be set in a free state and not to be flexed during the first half of the releasing operation, it is unnecessary to pull back the operating portion against the urging force of the resilient member during the releasing operation. During the second half of the releasing operation, the resilient member is easily flexed in the connector releasing direction by virtue of the tapered surfaces provided on the inner sides of the abutment projections. Hence, it is possible to improve the operating efficiency during the releasing operation.

Furthermore, to achieve the above object, according to a second aspect of the present invention, there is provided a half-fitting prevention connector which comprises:

a first connector including a first housing;

a flexible lock arm formed on the first housing, the flexible lock arm having a first retaining portion and a pair of abutment portions which are located at a lower side relative to the first retaining portion, the pair of abutment portions having tapered surfaces which are opposed to each other so that an interval between the tapered surfaces becomes gradually wider in a connector releasing direction of the first connector;

a second connector fittable to the first connector, the second connector including a second housing having a second retaining portion and a press plate;

a coil spring attachable to the second housing, a longitudinal direction of the coil spring being substantially perpendicular to a connector fitting direction of the second connector;

a retaining piece, which is formed uprightly on the second housing, and has a nipping slot nipping a central portion of the coil spring, so that at least one of a rear end portion and an upper end portion of the central portion of the coil spring is retained; and a supporting projection which supports a front end portion of the central portion of the coil spring to fixedly secure the central portion of the coil spring to the second housing in cooperation with the retaining piece, so that opposite end portions of the coil spring are flexible in the connector fitting direction and a connector releasing direction of the second connector, wherein when the first connector and the second connector are about to be fitted to each other, the flexible lock arm is flexed by the press plate of the second housing pressing downward the first retaining portion, and the first retaining portion is slid on the press plate so that the pair of abutment portions of the flexible lock arm are abutted against the opposite end portions of the coil spring, wherein when the first connector and the second connector are incompletely fitted, the first connector and the second connector are released in respective directions opposite to their connector fitting directions in accordance with a resilient force of the coil spring, and wherein when the first connector and the second connector are completely fitted to each other, the first retaining portion of the flexible lock arm is retained by the second retaining portion of the second housing.

In accordance with the second aspect of the present invention, for example, a coil spring may be employed as a resilient member. Accordingly, since the coil spring has the form of the most widespread spring, the coil spring can be produced at low cost. Further, in accordance with the second aspect, for example, a retaining piece and a supporting projection may be employed as a fixing mechanism for the coil spring. Therefore, the coil spring can be easily fixed by such the fixing mechanism with which the coil spring is clamped between the retaining piece and the supporting projection. Accordingly, the assembling operation at the time of attaching the coil spring in the housing can be facilitated, thereby making it possible to improve productivity and attain a reduction in cost.

Furthermore, to achieve the above object, according to a third aspect of the present invention, there is provided a half-fitting prevention connector which comprises:

a first connector including a first housing;

a flexible lock arm formed on the first housing, the flexible lock arm having a first retaining portion and a pair of abutment portions which are located at a lower side relative to the first retaining portion, the pair of abutment portions having tapered surfaces which are opposed to each other so that an interval between the tapered surfaces becomes gradually wider in a connector releasing direction of the first connector;

a second connector fittable to the first connector, the second connector including a second housing having a second retaining portion and a press plate;

a balanced-type spring attachable to the second housing, a longitudinal direction of the balanced-type spring being substantially perpendicular to a connector fitting direction of the second connector, the balanced-type spring including:

a central fixing portion, a pair of flexible portions which are extended laterally from opposite sides of the central fixing portion, and a pair of inwardly convoluted portions, which are located at opposite end portions of the balanced-type spring and are formed by inwardly convoluting tips of the pair of flexible portions;

a retaining column formed uprightly on the second housing, the retaining column having a flange portion, which is formed on an upper end portion of the retaining column, and with which the central fixing portion of the balanced-type spring is retained; and a pair of receiving projections which receive rear end portions of the pair of flexible portions at positions adjacent to the central fixing portion to fixedly secure the balanced-type spring to the second housing in cooperation with the retaining column, so that the pair of inwardly convoluted portions of the balanced-type spring are flexible in the connector fitting direction and a connector releasing direction of the second connector, wherein when the first connector and the second connector are about to be fitted to each other, the flexible lock arm is flexed by the press plate of the second housing pressing downward the first retaining portion, and the first retaining portion is slid on the press plate so that the pair of abutment portions of the flexible lock arm are abutted against the pair of inwardly convoluted portions of the balanced-type spring, wherein when the first connector and the second connector are incompletely fitted, the first connector and the second connector are released in respective directions opposite to their connector fitting directions in accordance with a resilient force of the balanced-type spring, and wherein when the first connector and the second connector are completely fitted to each other, the first retaining portion of the flexible lock arm is retained by the second retaining portion of the second housing.

In accordance with the third aspect of the present invention, for example, a balanced-type spring may be employed as a resilient member. Since the inwardly convoluted portions are provided on such the balanced-type spring, when the balanced-type spring is pressed in the connector fitting direction by the abutment projections, the abutment projections are difficult to be dislocated from the opposite end portions of the spring, and the urging force becomes strong. On the other hand, when the balanced-type spring is pressed in the connector releasing direction at the ti me of the releasing operation of the connectors, the abutment projections are easily dislocated from the opposite end portions of the spring, and the urging force becomes weak. Therefore, an undue stress is not applied to the spring, and the fitting and releasing operations are facilitated.

Further, in accordance with the third aspect, for example, a retaining column and a receiving projection may be employed as a fixing mechanism for the balanced-type spring. Therefore, the balanced-type spring can be easily fixed by such the fixing mechanism with which the central fixing portion of the balanced-type spring is retained and clamped. Accordingly, the assembling operation and the fitting and releasing operations at the time of attaching the balanced-type spring to the housing are facilitated, and the life of such the spring is prolonged, thereby making it possible to improve the reliability of the connector.

BRIEF DESCRIPTION OF THE DRAWINGS

The above and other objects and advantages of the present invention will become more apparent by describing in detail preferred embodiments thereof with reference to the accompanying drawings, wherein.

DETAILED DESCRIPTION OF THE PREFERRED EMBODIMENTS

Referring now to FIGS. 1 to 8, a detailed description will be given of preferred embodiments of a half-fitting prevention connector in accordance with the present invention.

Figure 1:
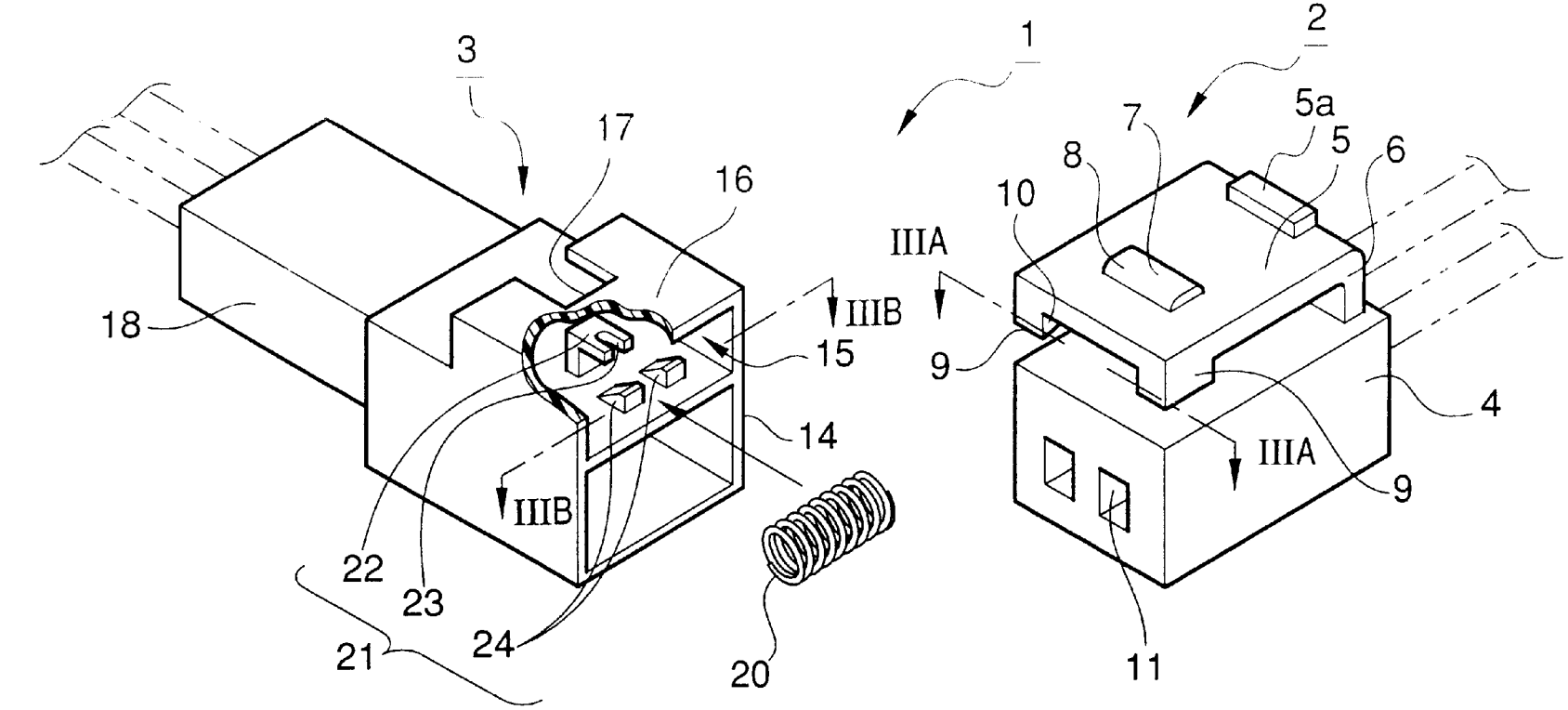
FIG. 1 is an exploded perspective view illustrating an embodiment of a half-fitting prevention connector in accordance with the present invention.
Figure 2:
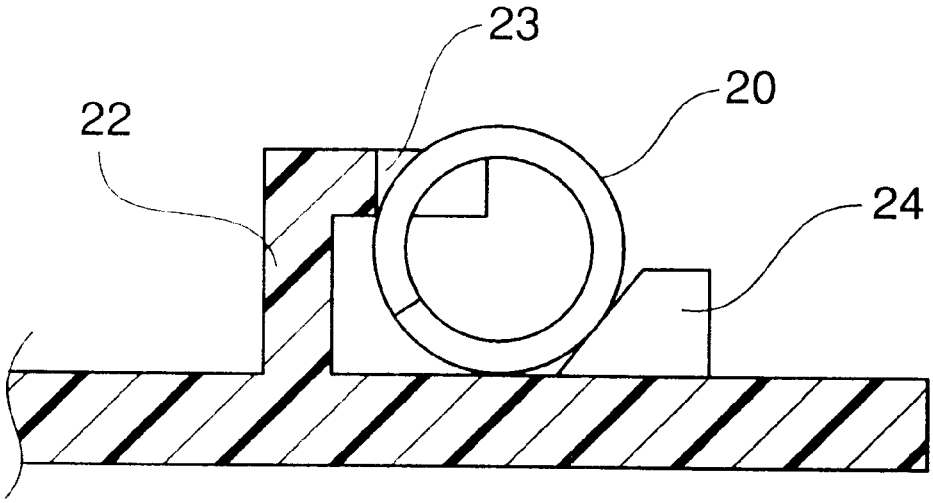
FIG. 2 is an enlarged cross-sectional view of an essential section shown in FIG. 1.
Figure 3:
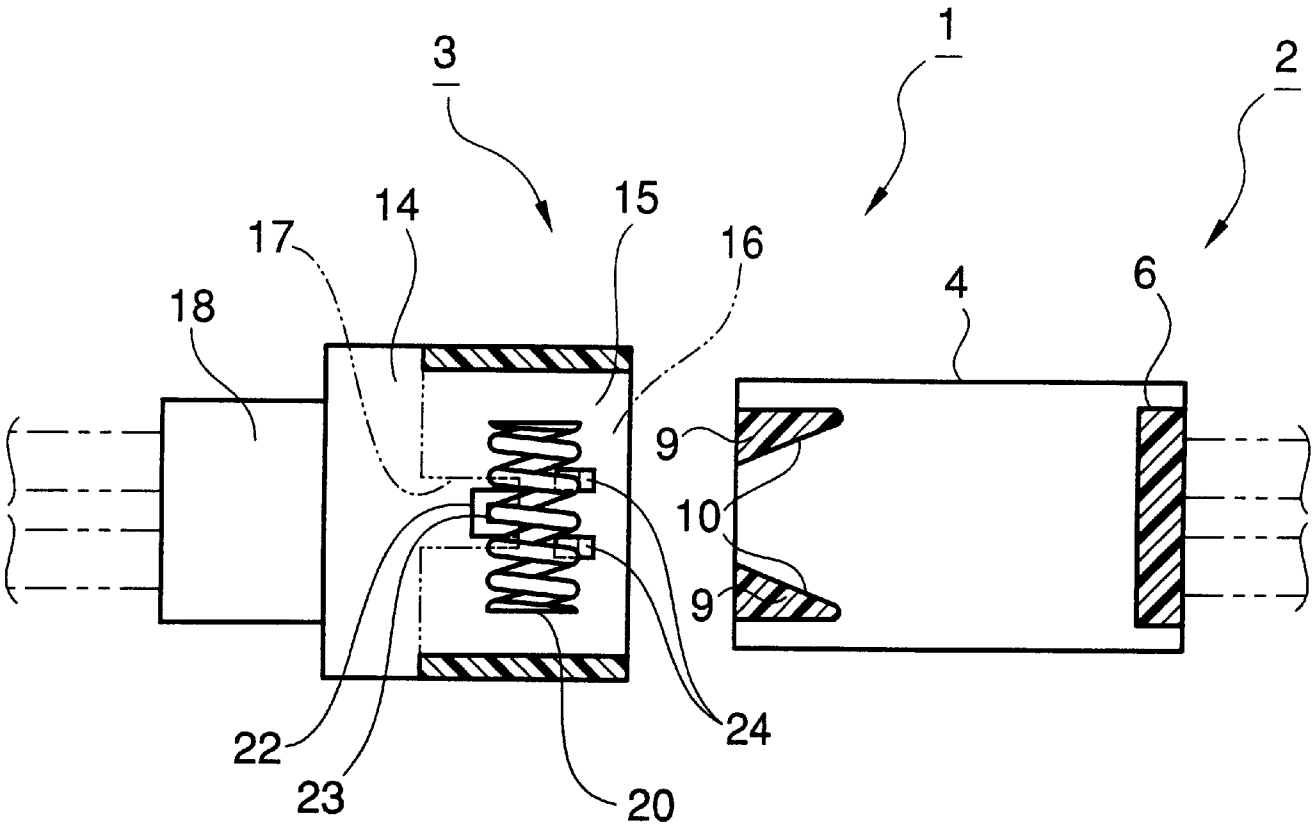
FIG. 3 is an operational diagram illustrating a state in which male and female connectors shown in FIG. 1 are starting to be fitted, and is across-sectional view taken along lines IIIA—IIIA and IIIB—IIIB.

As shown in FIGS. 1 to 3, in a half-fitting prevention connector 1 in this embodiment, half-fitting between a pair of male and female connectors 2 and 3 which are fittable to each other is prevented by the resiliency of a coil spring 20 serving as a spring member and accommodated in a housing 14 of the female connector 3. Further, at the time of fitting with the male connector 2, a lock arm 5, which is supported at its rear end by a column 6 on a housing 4 of the male connector 2 and has a retaining pawl 7 on its upper surface, is flexed in cooperation with the spring member 20 so as to be retained in a retaining recess 17 in the female connector 3, thereby effecting the mutual engagement between the male and female connectors 2 and 3.

It should be noted that a terminal accommodating chamber 11 for accommodating a pair of connecting terminals, e.g., a pair of female terminals having covered wires connected to their rear ends, is provided inside the housing 4 of the male connector 2. Meanwhile, a terminal accommodating chamber 18 for accommodating a pair of connecting terminals, e.g., a pair of male terminals having covered wires connected to their rear ends, is provided at the rear of the housing 14 of the female connector 3. The housing 14 is fitted in such a manner as to cover outer surfaces of the housing 4.

Both ends of the coil spring 20 are flexible simultaneously in a connector fitting direction or a connector releasing direction with its central portion serving as a reference, and the central portion of the coil spring 20 is fixed in an exclusive space 15 in an upper portion of the housing 14 by a fixing mechanism 21 in a state in which the coil spring 20 is laid in a transverse direction orthogonal to the connector fitting direction of the connector. The top plate of the female housing 14 above the exclusive space 15 is formed as a press plate 16 for pressing the retaining pawl 7 downward and causing it to slide, and the retaining recess 17 for retaining the retaining pawl 7 is formed on the rear side of the press plate 16.

Further, a pair of abutment projections 9 for abutting against both ends of the coil spring 20 are provided on the lower side of the lock arm 5 below the retaining pawl 7. Tapered surfaces 10 are respectively formed on the inner sides, i.e., mutually facing sides, of the abutment projections 9 such that the interval therebetween becomes gradually wider toward the rear.

Incidentally, an inclined surface 8 which is inclined forward is provided on an upper surface of the retaining pawl 7 so as to deflect the lock arm 5 downward as the retaining pawl 7 slips underneath the lower surface of the press plate 16 during the fitting operation.

In addition, the fixing mechanism 21 of the coil spring 20 is provided uprightly in one housing 14 and is comprised of a pair supporting projections 24 for supporting a front end of the coil spring 20 as well as a retaining piece 22 having a nipping notch 23 for nipping the spring wire at a central portion of the coil spring 20 and adapted to retain a rear end and an upper end of the central portion of the coil spring 20.

In the half-fitting prevention connector 1 having the above-described construction, the coil spring 20 is pushed into the exclusive space in the upper portion of the housing 14 in a state in which the coil spring 20 is laid in a transverse direction (in a direction orthogonal to the connector fitting direction) while causing the spring wire at the central portion of the coil spring 20 to be nipped in the nipping notch 23 in the retaining pawl 22. Accordingly, as shown in FIGS. 2 and 3, the front end of the central portion of the coil spring 20 is pressed and fixed by the retaining piece 22, and the rear end of the central portion is supported by the supporting projections 24. As a result, the coil spring 20 is accommodated in the exclusive space 15.

Further, a pair of female terminals, to which covered wires (not shown) are respectively connected, are inserted into the terminal accommodating chamber 11 from its rear side, and are retained by retaining lances (not shown) provided in the terminal accommodating chamber 11. Meanwhile, a pair of male terminals, to which covered wires (not shown) are respectively connected, are inserted into the terminal accommodating chamber 18 in the rear portion of the housing 14 from its rear side, and are retained by retaining lances (not shown) provided in the terminal accommodating chamber 18.

Next, referring to FIGS. 1 to 6, a description will be given of the fitting operation of the male and female connectors.

First, as shown in FIGS. 1 and 3, the male and female connectors 2 and 3 are made to face each other and are pressed toward each other in the connector fitting directions. Then, since the inclined surface 8 of the retaining pawl 7 abuts against the press plate 16, the lock arm 5 is flexed downward. Then, if the male connector 2 is further pressed in the connector fitting direction, the retaining pawl 7 advances while sliding on the inner surface of the press plate 16.

Figure 4:
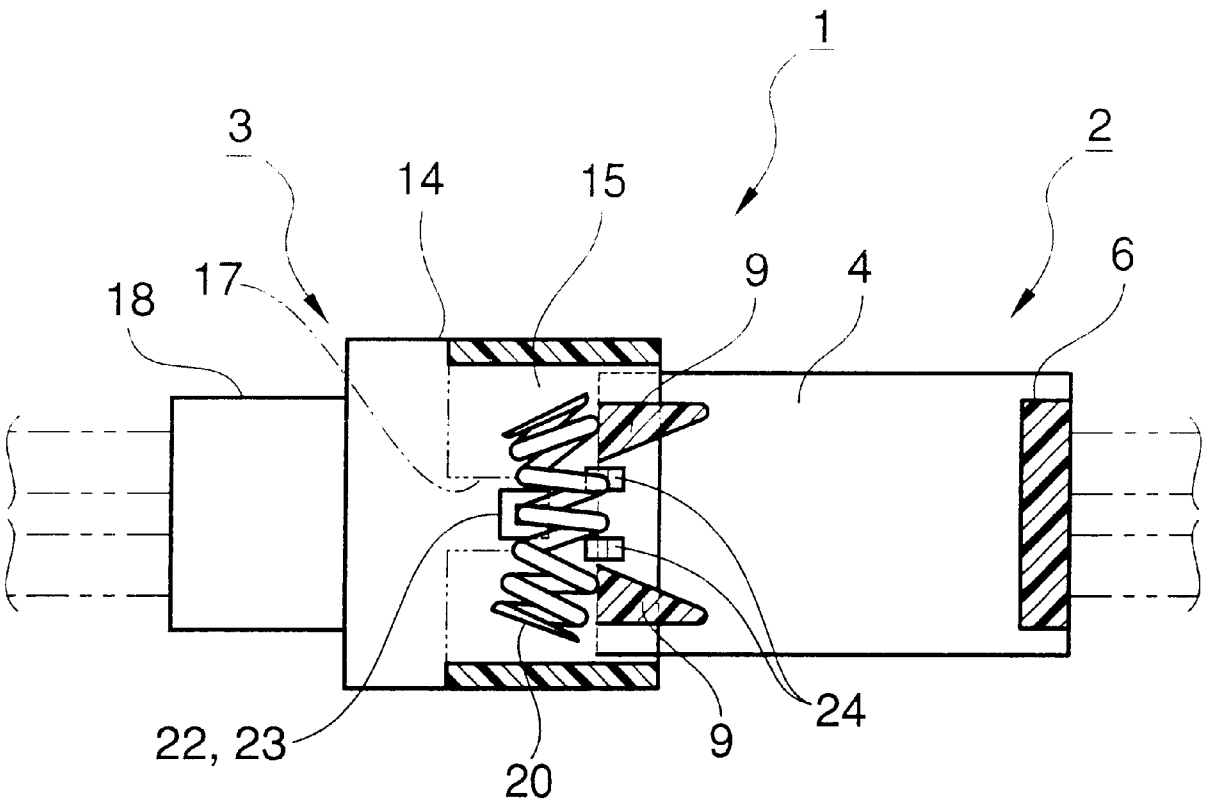
FIG. 4 is an operational diagram illustrating a state in which the male and female connectors shown in FIG. 1 are fitted halfway.

Subsequently, as shown in FIG. 4, both side end portions of the coil spring 20 respectively abut against the abutment projections 9 located on the lower side of the front end of the lock arm 5, the both side end portions of the coil spring 20 are flexed rearwardly, so that the urging force in the direction opposite to the connector fitting direction gradually increases. At this juncture, the male and female connectors 2 and 3 are pressed against each other in a state in which insofar as the lock arm 5 is downwardly flexed, the front end faces of the abutment projections 9 are not dislocated from the both side end portions of the coil spring 20 since the front end faces of the abutment projections 9 are substantially vertical.

Then, if the connector fitting force is canceled in the half-fitted state persisting immediately before the retaining pawl 7 is engaged in the retaining slot 17, the make connector 2 is pushed back by the urging force of the coil spring 20, thereby preventing the half-fitting between the connectors.

Next, if the male connector is further pressed in the half-fitted state, the retaining pawl 7 is engaged in the retaining recess 17, as shown in FIG. 4. Then, since the abutment projections 9 located on the lower surface of the front end of the lock arm 5 are displaced upward, the abutment projection 9 are dislocated from the both side end portions of the coil spring 20, so that the coil spring 20 is set in a free state. Then, whether the state is the half-fitted state or the completely-fitted state can be determined by visually observing the state of engagement between the retaining pawl 7 and the retaining recess 17.

Figure 5:
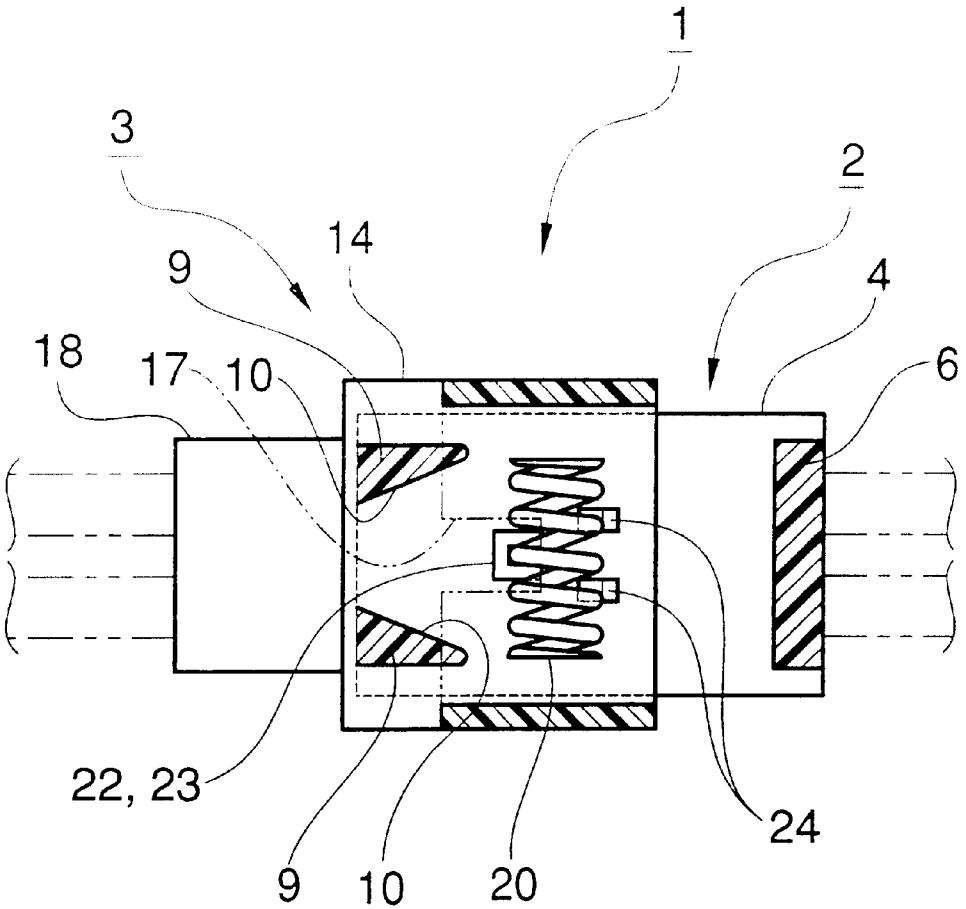
FIG. 5 is a cross-sectional view illustrating a state in which the male and female connectors shown in FIG. 1 are completely fitted.
Figure 6:
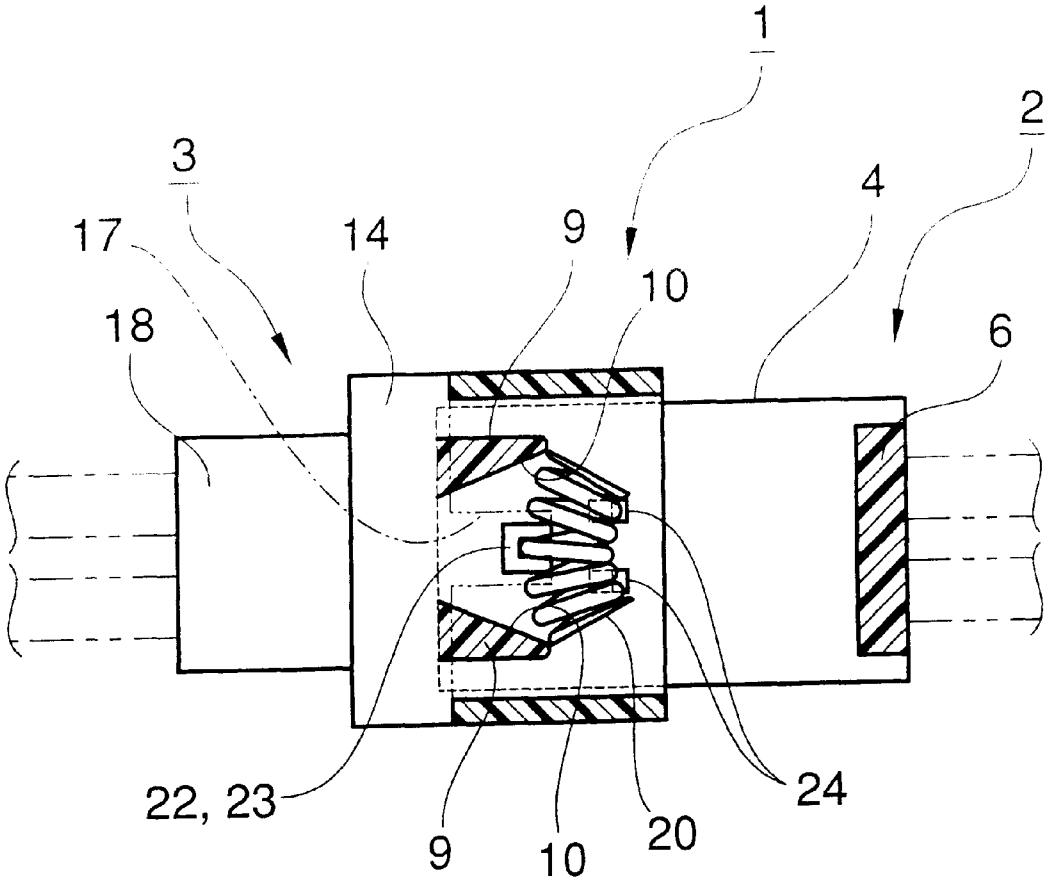
FIG. 6 is an operational diagram illustrating a state in which the male and female connectors shown in FIG. 5 are released.

Next, to cancel the completely-fitted state of the male and female connectors, if the operator presses an operating portion 5a while holding the housings 4 and 14 of the male and female connectors 2 and 3, as shown in FIG. 6, so as to cancel the fitting between the retaining pawl 7 and the retaining recess 17, and the male and female connectors 2 and 3 are pulled away from each other, the fitting of the connectors is canceled in a procedure opposite to that of the above-described fitting operation. However, even if the lock arm 5 is flexed downward, the coil spring 20 is in an unloaded free state during the first half of the releasing operation, as shown in FIG. 5. Accordingly, since the urging force of the coil spring 20 is not applied, the force with which the male connector 2 is pulled away from the female connector 3 while deflecting the lock arm 5 can be small.

In addition, during the latter half of the releasing operation, as shown in FIG. 6, since the tapered surfaces 10 are formed on the inner sides of the abutment projection 9, the abutment projection 9 can easily slip away by flexing the both end portions of the coil spring 20 despite the fact that the lock arm 5 is flexed downward.

As described above, with the half-fitting prevention connector 1 in accordance with this embodiment, both side ends of the coil spring 20 are flexible simultaneously in the connector fitting direction or the connector releasing direction with its central portion serving as a reference, and the central portion of the coil spring 20 is fixed in the exclusive space 15 in the upper portion of the housing 14 by the fixing mechanism 21 in a state in which the coil spring 20 is laid in the transverse direction orthogonal to the connector fitting direction. In addition, the top plate of the female housing 14 above the exclusive space 15 is formed as the press plate 16 for pressing the retaining paw 17 downward and causing it to slide, and the retaining recess 17 for retaining the retaining pawl 7 is formed on the rear side of the press plate 16. Further, the pair of abutment projections 9 for abutting against both ends of the coil spring 20 are provided on the lower side of the lock arm 5, and the tapered surfaces 10 are respectively formed on the inner sides of the abutment projections 9 such that the interval therebetween becomes gradually wider toward the rear.

Accordingly, since a slider is not required, the number of component parts can be reduced, the structure is simplified, and the number of assembling steps can be reduced. Furthermore, since the amount of the flexion of the lock arm 5 during fitting and releasing operations of the male and female connectors 2 and 3 is small, and resin members other than the lock arm 5 are not flexed, it is possible to improve the durability of the connector.

In addition, since the coil spring 20 is in the free state and is not flexed during the first half of the releasing operation, it is unnecessary to pull back the operating portion against the urging force of the coil spring 20 during the releasing operation for the connectors. Moreover, since the both end portions of the coil spring 20 are easily flexed in the connector releasing direction by the tapered surfaces 10 on the inner sides of the abutment projection 9 during the latter half of the releasing operation for the connectors, thereby facilitating the releasing operation. Accordingly, it is possible to improve the operating efficiency during the releasing operation.

In addition, the fixing mechanism 21 is provided uprightly in one housing 14 and is comprised of the pair supporting projections 24 for supporting the front end of the coil spring 20 as well as the retaining piece 22 having the nipping notch 23 for nipping the spring wire at a central portion of the coil spring 20 and adapted to retain the rear end and the upper end of the central portion of the coil spring 20. Accordingly, since the coil spring has the form of the most widespread spring, the coil spring can be produced at low cost.

Further, the fixing mechanism 21 of the coil spring 20 is so arranged to be fixed if the spring wire at the central portion of the coil spring 20 is placed in the nipping notch 23, and the central portion of the coil spring 20 is clamped by the retaining piece 22 and the supporting projections 24. Accordingly, the assembling operation at the time of fitting the coil spring 20 in the housing 14 is facilitated, thereby making it possible to enhance the productivity.

Figure 7:
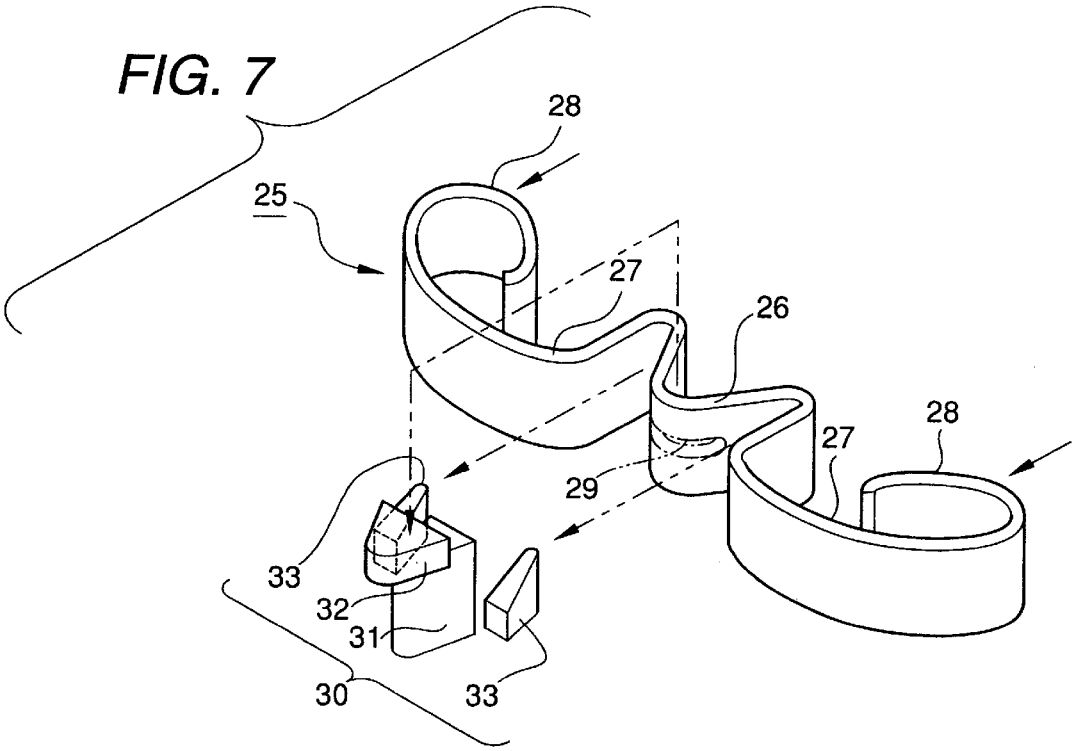
FIG. 7 is a perspective view illustrating a modification of a spring member of the half-fitting prevention connector in accordance with the present invention and a fixing mechanism entailed by the modification.

Next, as a modification of the coil spring serving as the spring member, a description will be given of a balanced-type leaf spring 25 shown in FIG. 7. This balanced-type leaf spring 25 is formed by bending a strip into a zigzag form in a plan view, and is comprised of a central fixing portion 26, a pair of flexible portions 27 continuing and extending laterally from both sides of the central fixing portion 26, and a pair of inwardly convoluted portions 28 which are respectively formed by inwardly convoluting tips of the flexible portions 27. In correspondence with this arrangement, a fixing mechanism 30 is comprised of a retaining column 31 with a substantially triangular cross section which is provided uprightly in one housing to retain the central fixing portion 26 and has a flange portion 32 at its upper end, as well as a pair of receiving projections 33 for receiving rear ends of the flexible portions 27 at positions close to their central portions.

With the balanced-type leaf spring 25 having the above-described construction, since the inwardly convoluted portions 28 are provided, when the balanced-type leaf spring 25 is pressed in the connector fitting direction (in the direction indicated by the arrow in FIG. 1) by the abutment projection 9 (see FIG. 1), the abutment projection 9 are difficult to be dislocated from the both side end portions of the balanced-type leaf spring 25, and the urging force becomes strong. On the other hand, when the balanced-type leaf spring 25 is pressed in the direction opposite to the connector fitting direction at the time of the releasing operation for the connectors, the abutment projection 9 are easily dislocated from the both side end portions of the balanced-type leaf spring 25, and the urging force becomes weak. Therefore, an undue stress is not applied to the balanced-type leaf spring 25, and the fitting and releasing operations are facilitated.

In addition, the fixing mechanism 30 for the balanced-type leaf spring 25 can be easily fixed if the central fixing portion 26 is retained by the retaining column 31 and the flange portion 32, and is then clamped by the retaining column 31 and the receiving projections 33.

Furthermore, if a retaining slot 29 is provided in the central fixing portion 26, and the height of the retaining column 31 is lowered to allow the flange portion 32 to be fitted in the retaining slot 29, it is possible to prevent the central fixing portion 26 from being lifted upward.

In addition, since the balanced-type leaf spring 25 is formed by bending a strip into a zigzag form in a plan view, the balanced-type leaf spring 25 can be stably mounted in the exclusive space 15 in the upper portion of the housing 14 (see FIG. 1). Accordingly, the assembling operation and the fitting and releasing operations are facilitated when the balanced-type leaf spring 25 is fitted in the housing.

Figure 8:
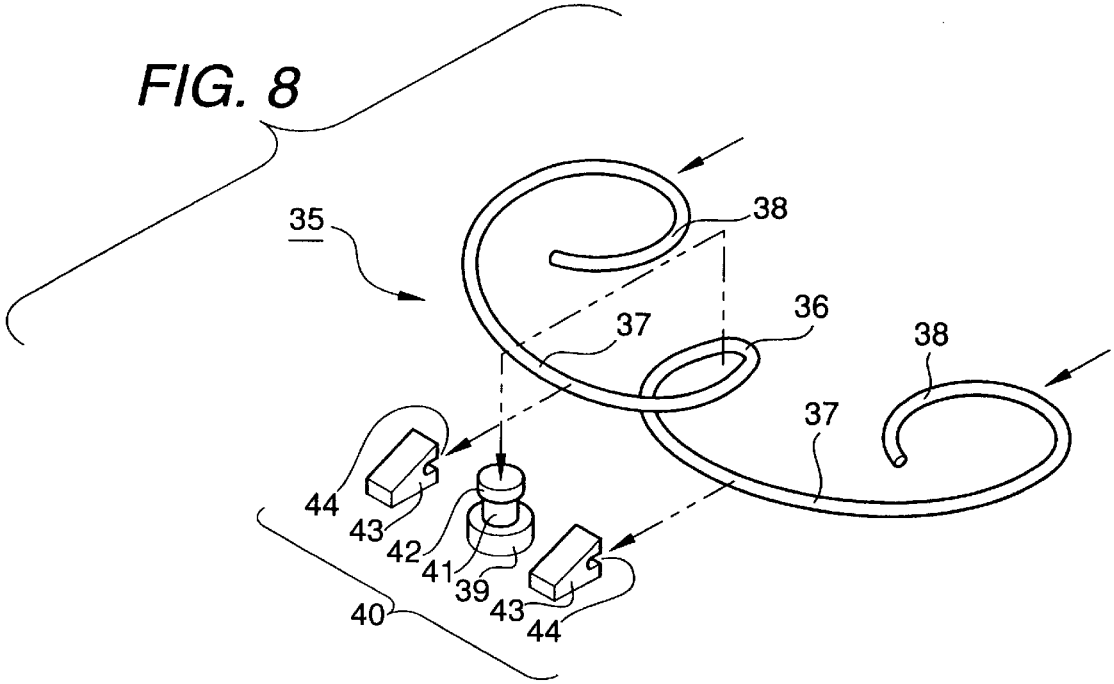
FIG. 8 is a perspective view illustrating another modification of the spring member of the half-fitting prevention connector in accordance with the present invention and the fixing mechanism entailed by the modification.
Figure 9:
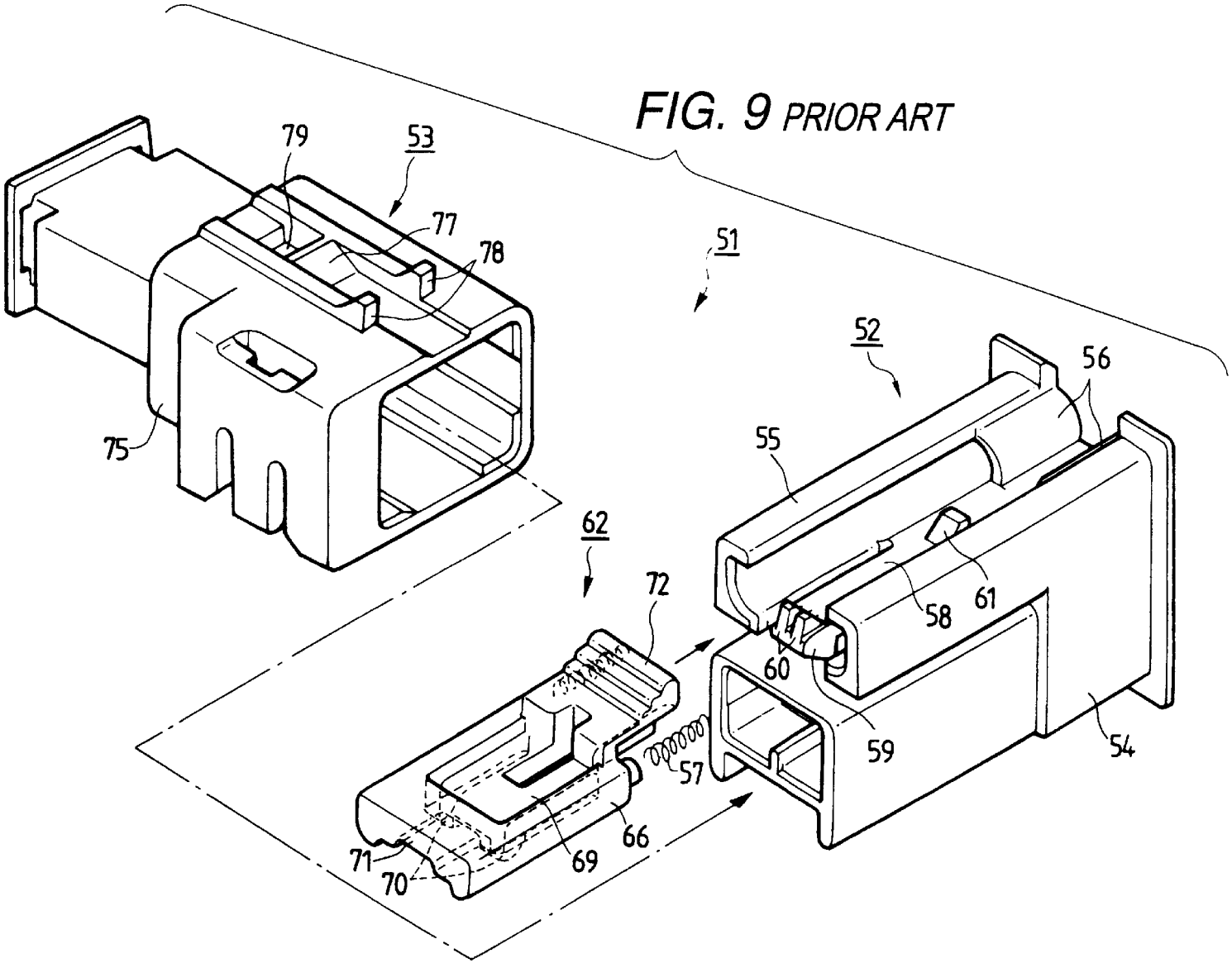
FIG. 9 PRIOR ART
FIG. 9. is an exploded perspective view illustrating an example of a related half-fitting prevention connector.
Figure 10:
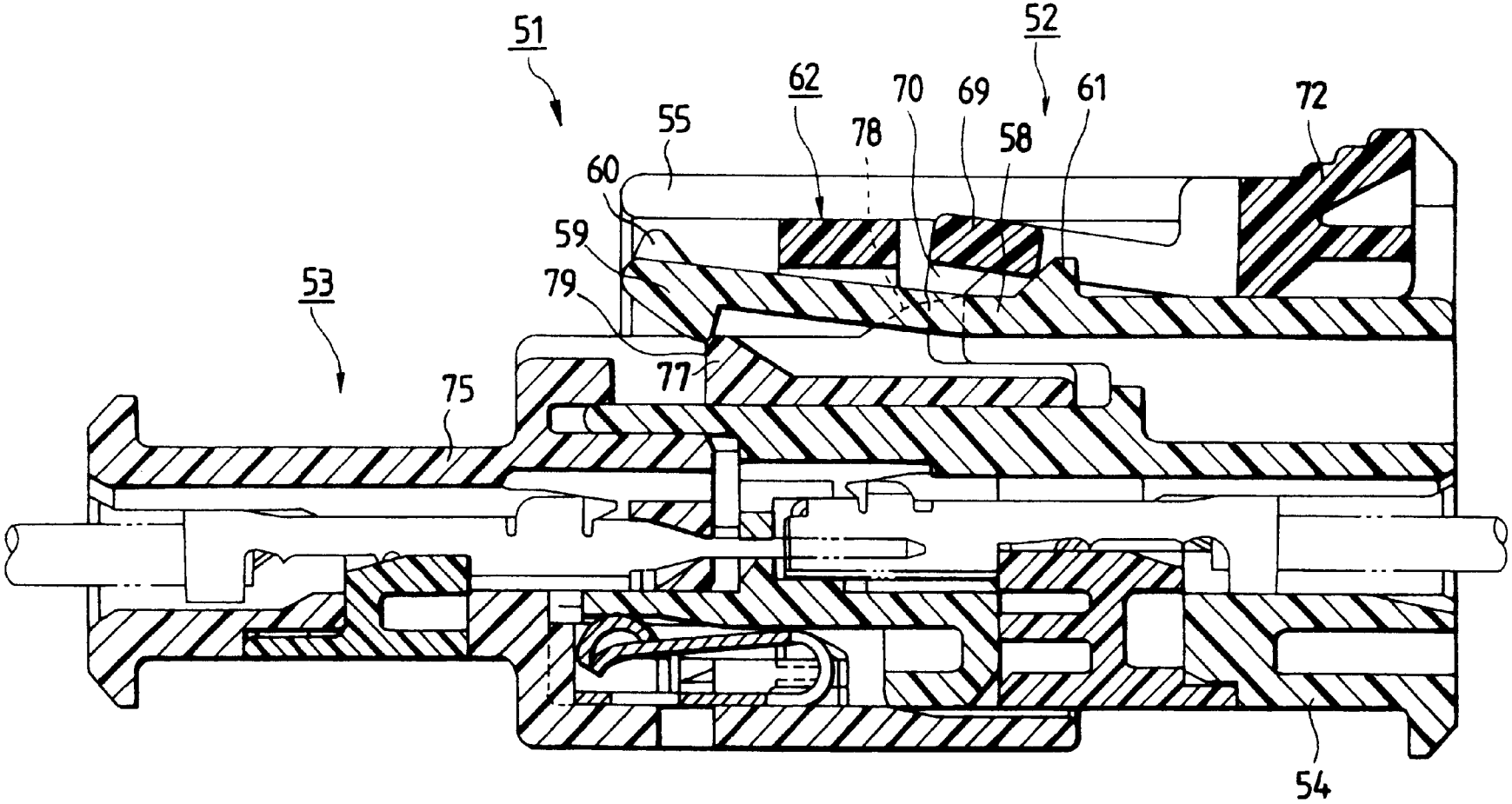
FIG. 10 PRIOR ART
FIG. 10 is an operational diagram illustrating a state in which male and female connectors shown in FIG. 9 are fitted halfway.
Figure 11:
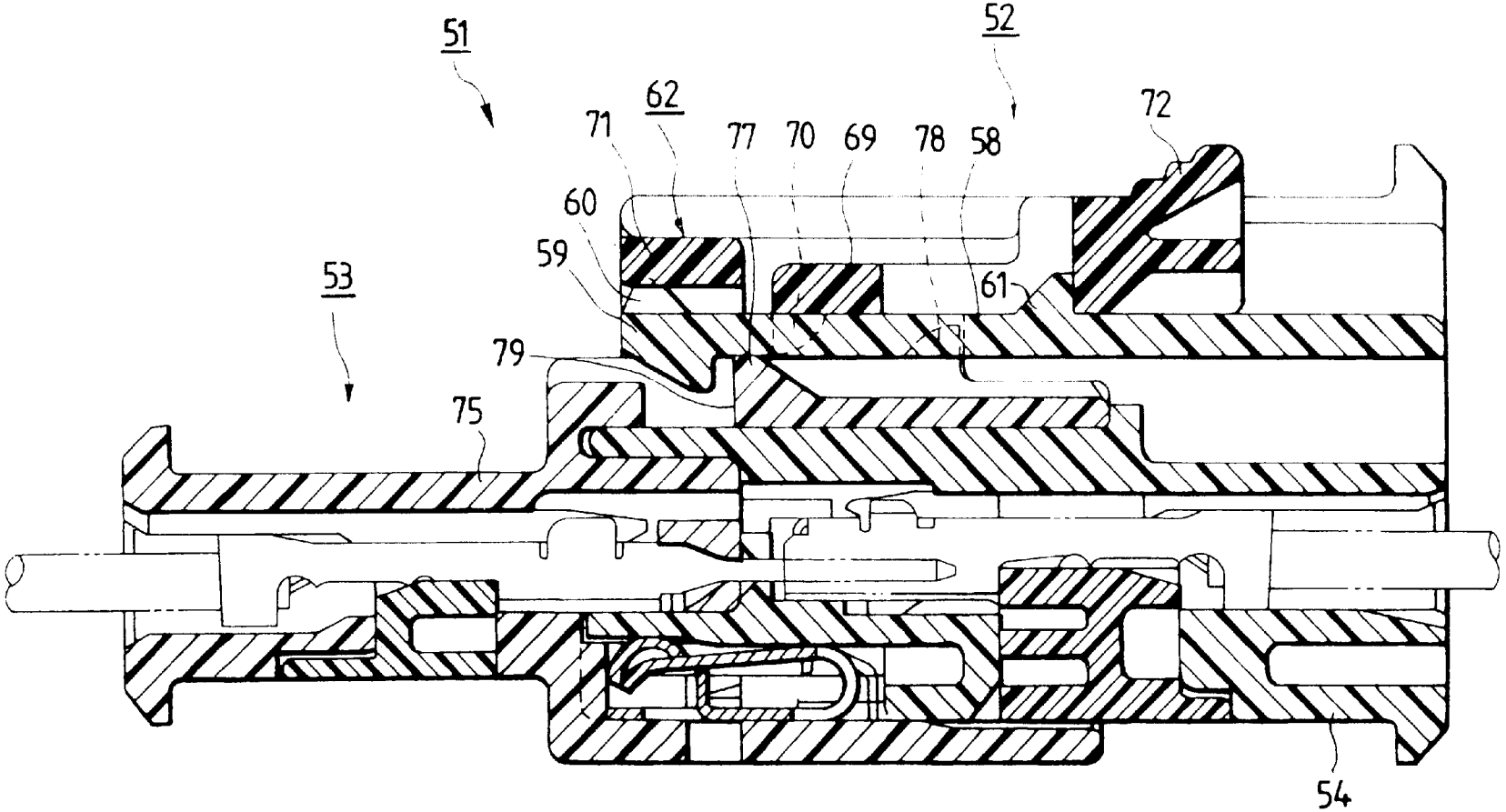
FIG. 11 PRIOR ART
FIG. 11 is an operational diagram illustrating a state in which the male and female connectors shown in FIG. 9 are completely fitted.
Figure 12:
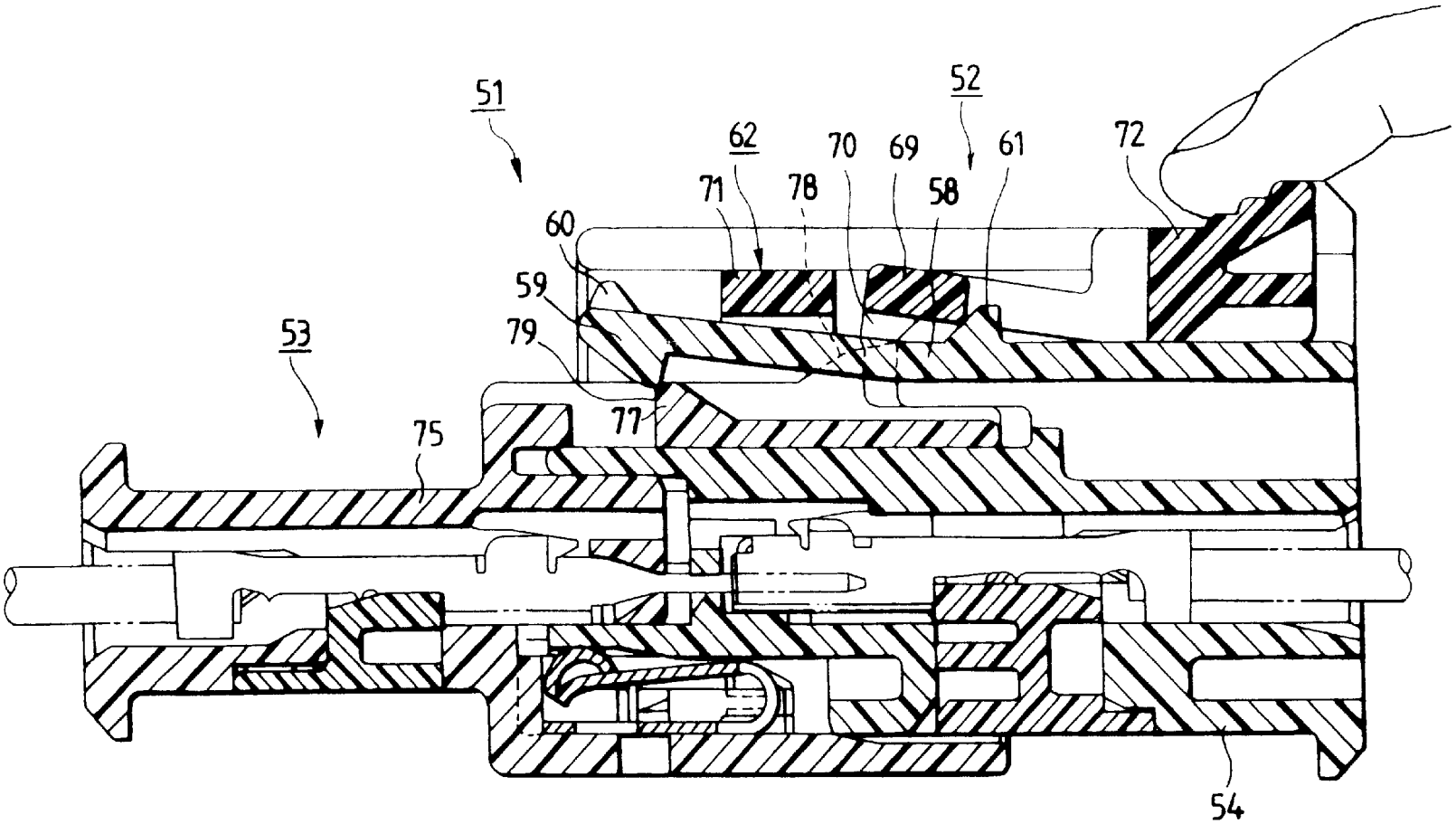
FIG. 12 PRIOR ART
FIG. 12 is an operational diagram illustrating a state in which the male and female connectors shown in FIG. 11 are released.

Next, as another modification of the coil spring serving as the spring member, a description will be given of a balanced-type wire spring 35 shown in FIG. 8. This balanced-type wire spring 35 is formed by bending a wire into a curled form in a plan view, and is comprised of a central fixing portion 36, a pair of flexible portions 37 continuing and extending laterally from both sides of the central fixing portion 36, and a pair of inwardly convoluted portions 38 which are respectively formed by inwardly convoluting tips of the flexible portions 37. In correspondence with this arrangement, a fixing mechanism 40 is comprised of a retaining column 41 with a substantially circular cross section which is provided uprightly in one housing to retain the central fixing portion 36 and has a flange portion 42 at its upper end and a raised bottom base 39 at its lower end, as well as a pair of receiving projections 43 each having a retaining groove for receiving a rear end of the flexible portion 37 at a position close to its central portion.

With the balanced-type wire spring 35 having the above-described construction, since the inwardly convoluted portions 38 are provided, when the both side end portions of the balanced-type wire spring 35 are pressed in the connector fitting direction (in the direction indicated by the arrow in FIG. 1) by the abutment projection 9 (see FIG. 1), the abutment projection 9 are difficult to be dislocated from the both side end portions of the balanced-type wire spring 35, and the urging force becomes strong. On the other hand, when the both side end portions of the balanced-type wire spring 35 are pressed in the direction opposite to the connector fitting direction at the time of the releasing operation for the connectors, the abutment projection 9 are easily dislocated from the both side end portions of the balanced-type wire spring 35, and the urging force becomes weak. Therefore, an undue stress is not applied to the balanced-type wire spring 35, and the fitting and releasing operations are facilitated.

In addition, the fixing mechanism 40 for the balanced-type wire spring 35 can be easily fixed if the central fixing portion 36 is placed on the raised bottom base 39 and is retained by the retaining column 41 and the flange portion 42, and is then clamped by the retaining column 41 and the receiving projections 43 having the holding grooves 44/

In addition, since the balanced-type wire spring 35 is formed by bending a wire in a plane, if the balanced-type wire spring 35 is placed as it is on the housing 14, the balanced-type wire spring 35 is unable to abut against the abutment projection 9. Therefore, a fixed height is secured for the balanced-type wire spring 35 by the raised bottom base 39 and the holding grooves 44.

Furthermore, by using a plurality of balanced-type wire springs 35 in a superposed manner, it is possible to increase the urging force and adjust the force for preventing half-fitting between the connectors. Accordingly, the assembling operation and the fitting and releasing operations at the time of fitting the balanced-type wire springs 35 in the housing 14 can be facilitated, the adjustment of the above-described characteristic becomes possible, and the life of the connector is prolonged, thereby improving the reliability.

It should be noted that the present invention is not limited to the above-described embodiment, and may be implemented in other forms by making appropriate modifications. For example, although in the of the balanced-type leaf spring 25 are formed by being merely bent in one direction as shown in FIG. 7, the flexible portions 27 of the balanced-type leaf spring 25 may be formed by being bent a plurality of times into a zigzag form. Thus, by lowering the spring constant, it is possible to prevent the urging force from increasing sharply as the fitting progresses.

It is contemplated that numerous modifications may be made to the half-fitting prevention connector of the present invention without departing from the spirit and scope of the invention as defined in the following claims.

What is claimed is:

1. A half-fitting prevention connector, comprising:

a first connector including a first housing and a connector fitting direction;

a flexible lock arm formed on the first housing, the flexible lock arm having a first retaining portion and a pair of abutment portions which are located at a lower side of the flexible lock arm relative to the first retaining portion, the pair of abutment portions having tapered surfaces which are opposed to each other so that an interval between the tapered surfaces becomes gradually wider in a connector releasing direction of the first connector;

a second connector fittable to the first connector, the second connector including a second housing having a second retaining portion and a press plate;

a resilient member attachable to the second housing, a longitudinal direction of the resilient member being substantially perpendicular to a connector fitting direction of the second connector; and a fixing mechanism, with which a central portion of the resilient member is fixedly secured to the second housing, so that opposite end portions of the resilient member are flexible in the connector fitting direction and a connector releasing direction of the second connector, wherein when the first connector and the second connector are about to be fitted to each other, the flexible lock arm is flexed by the press plate of the second housing pressing downward the first retaining portion, and the first retaining portion is slid on the press plate so that the pair of abutment portions of the flexible lock arm are abutted against the opposite end portions of the resilient member, wherein when the first connector and the second connector are incompletely fitted, the first connector and the second connector are released in respective directions opposite to their connector fitting directions in accordance with a resilient force of the resilient member, and wherein when the first connector and the second connector are completely fitted to each other, the first retaining portion of the flexible lock arm is retained by the second retaining portion of the second housing.

2. A half-fitting prevention connector, comprising:

a first connector including a first housing and a connector fitting direction;

a flexible lock arm formed on the first housing, the flexible lock arm having a first retaining portion and a pair of abutment portions which are located at a lower side of the flexible lock arm relative to the first retaining portion, the pair of abutment portions having tapered surfaces which are opposed to each other so that an interval between the tapered surfaces becomes gradually wider in a connector releasing direction of the first connector;

a second connector fittable to the first connector, the second connector including a second housing having a second retaining portion and a press plate;

a coil spring attachable to the second housing, a longitudinal direction of the coil spring being substantially perpendicular to a connector fitting direction of the second connector;

a retaining piece, which is formed uprightly on the second housing, and has a nipping slot nipping a central portion of the coil spring, so that at least one of a rear end portion and an upper end portion of the central portion of the coil spring is retained; and a supporting projection which supports a front end portion of the central portion of the coil spring to fixedly secure the central portion of the coil spring to the second housing in cooperation with the retaining piece, so that opposite end portions of the coil spring are flexible in the connector fitting direction and a connector releasing direction of the second connector, wherein when the first connector and the second connector are about to be fitted to each other, the flexible lock arm is flexed by the press plate of the second housing pressing downward the first retaining portion, and the first retaining portion is slid on the press plate so that the pair of abutment portions of the flexible lock arm are abutted against the opposite end portions of the coil spring, wherein when the first connector and the second connector are incompletely fitted, the first connector and the second connector are released in respective directions opposite to their connector fitting directions in accordance with a resilient force of the coil spring, and wherein when the first connector and the second connector are completely fitted to each other, the first retaining portion of the flexible lock arm is retained by the second retaining portion of the second housing.

3. A half-fitting prevention connector, comprising:

a first connector including a first housing and a connector fitting direction;

a flexible lock arm formed on the first housing, the flexible lock arm having a first retaining portion and a pair of abutment portions which are located at a lower side of the flexible lock arm relative to the first retaining portion, the pair of abutment portions having tapered surfaces which are opposed to each other so that an interval between the tapered surfaces becomes gradually wider in a connector releasing direction of the first connector;

a second connector fittable to the first connector, the second connector including a second housing having a second retaining portion and a press plate;

a balanced-type spring attachable to the second housing, a longitudinal direction of the balanced-type spring being substantially perpendicular to a connector fitting direction of the second connector, the balanced-type spring including:

a central fixing portion, a pair of flexible portions which are extended laterally from opposite sides of the central fixing portion, and a pair of inwardly convoluted portions, which are located at opposite end portions of the balanced-type spring and are formed by inwardly convoluting tips of the pair of flexible portions;

a retaining column formed uprightly on the second housing, the retaining column having a flange portion, which is formed on an upper end portion of the retaining column, and with which the central fixing portion of the balanced-type spring is retained; and a pair of receiving projections which receive rear end portions of the pair of flexible portions at positions adjacent to the central fixing portion to fixedly secure the balanced-type spring to the second housing in cooperation with the retaining column, so that the pair of inwardly convoluted portions of the balanced-type spring are flexible in the connector fitting direction and a connector releasing direction of the second connector, wherein when the first connector and the second connector are about to be fitted to each other, the flexible lock arm is flexed by the press plate of the second housing pressing downward the first retaining portion, and the first retaining portion is slid on the press plate so that the pair of abutment portions of the flexible lock arm are abutted against the pair of inwardly convoluted portions of the balanced-type spring, wherein when the first connector and the second connector are incompletely fitted, the first connector and the second connector are released in respective directions opposite to their connector fitting directions in accordance with a resilient force of the balanced-type spring, and wherein when the first connector and the second connector are completely fitted to each other, the first retaining portion of the flexible lock arm is retained by the second retaining portion of the second housing.

* * * * *